US005793008A

United States Patent [19]

Mayo et al.

[11] Patent Number: 5,793,008

[45] Date of Patent: Aug. 11, 1998

[54] VACUUM INTERRUPTER WITH ARC DIFFUSING CONTACT DESIGN

[75] Inventors: Stephen David Mayo, Horseheads; Paul Graham Slade; Michael Bruce Schulman, both of Ithaca, all of N.Y.

[73] Assignee: Eaton Corporation, Cleveland, Ohio

[21] Appl. No.: 742,550

[22] Filed: Nov. 1, 1996

[51] Int. Cl.[6] ..... H01H 33/66

[52] U.S. Cl. ..... 218/129; 218/42; 218/127; 218/130

[58] Field of Search ..... 218/22–32, 118–41, 218/42

[56] References Cited

U.S. PATENT DOCUMENTS

| | | | |
|---|---|---|---|
| 3,792,214 | 2/1974 | Voshall | 218/136 |
| 3,889,080 | 6/1975 | Emmerich et al. | 318/136 |
| 4,117,288 | 9/1978 | Gorman et al. | 218/129 |
| 4,260,864 | 4/1981 | Wayland et al. | 218/129 |
| 4,345,126 | 8/1982 | Cherry et al. | 218/126 |
| 4,367,382 | 1/1983 | Suzuki et al. | 218/129 |
| 4,401,868 | 8/1983 | Wootton et al. | 218/127 |
| 4,451,813 | 5/1984 | Hirose et al. | 218/118 X |
| 4,743,718 | 5/1988 | Santilli | 218/130 |
| 4,760,223 | 7/1988 | Suzuki | 218/123 |
| 4,847,456 | 7/1989 | Bamford et al. | 218/141 |
| 4,880,947 | 11/1989 | Fey et al. | 218/118 |
| 5,387,771 | 2/1995 | Luehring | 218/129 |
| 5,438,174 | 8/1995 | Slade | 218/118 |

OTHER PUBLICATIONS

Schulman, M. B., et al., Sequential Modes of Drawn Vacuum Arcs Between Butt Contacts for the Currents in the 1 kA to 16 kA Range, IEEE Trans. Comp., Pkg., Manufact. Technol. A, vol. 18 pp. 417–422, Jun. 1995.

Kaneko, E. et al. Possibility of High Current Interruption of Vacuum Interruper With Low Surge Contact Material: Improved Ag–WC , IEE Trans. Pow. Del. vol. 10, pp. 797–803, Apr. 1995.

Slade, Paul G., The Vacuum Interrupter Contact, IEEE Trans. Comp. Hybrids, Manufact. Technol. vol. CHMT–7 pp. 25–32, Mar. 1984.

Heberlein, J.V.R. et al., The High Current Metal Vapor Arc Column Between Separating Electrodes, IEEE Trans. Plasma Sci. vol. PS–8, pp. 283–288, Dec. 1980.

*Primary Examiner*—J. R. Scott

*Attorney, Agent, or Firm*—Martin J. Moran

[57] ABSTRACT

A vacuum circuit interrupter has a coil for generating an axially oriented magnetic field to maintain an electric arc in a diffuse rather than columnar mode upon opening of the interrupter. At least one of two electrodes having abuttable disc shaped contacts is movable along an axis relative to the other and can be forced by an external mechanism to open. The electrodes are carried in a housing with an electrical insulator between opposite end mountings that support the electrodes with the contacts in an evacuated enclosure. One of the electrodes is an assembly including a rigid supporting member attached to one of the contacts and extending a length along the axis. A coil is wrapped circumferentially around the supporting member along this length, providing a conductive path to generate the axial magnetic field. The supporting member comprises a less-conductive path (e.g., a stainless steel sleeve) and the coil is more conductive (e.g., copper), providing a durable and inexpensive structure.

9 Claims, 3 Drawing Sheets

VACUUM INTERRUPTER WITH ARC DIFFUSING CONTACT DESIGN

BACKGROUND OF THE INVENTION

1. Field of the Invention

The invention relates to the field of protective interrupters for electric power distribution circuits, particularly high power circuits. The invention provides a configuration for the contacts that separate mechanically in a vacuum to interrupt high currents, by diffusing the arc that forms between the contacts.

2. Prior Art

Vacuum interrupters are used in devices that protect electric power distribution systems from damage due to short circuits, in distribution reclosers, clad switchgear, tap changers and other forms of contactors. A conventional vacuum interrupter includes two high purity gas-free metal contacts housed in an evacuated envelope at a gas pressure of about $10^{-6}$ torr. The contacts are mechanically abutted together, typically by the force of a spring in an external mechanism, when carrying current between the two interrupter contacts. One or both contacts is movable such that the contacts can be mechanically separated from one another to break the circuit in which the interrupter is coupled. Usually, one of the contacts is stationary and the other is movable, the movable contact being termed the bellows contact.

An electric arc is drawn between the contacts when the contacts are separated while current is flowing. Although a vacuum interrupter normally has a very low internal gas pressure, the arc burns in metal vapor evaporated from local hot spots on the surfaces of the contacts as the arc is drawn. Ionized metal vapor continuously migrates away from the region of the arc, and condenses or plates onto available surfaces, primarily on the contact surfaces and typically on a metal shield surrounding the area of the arc. The shield is placed so as to protect the inner surface of a housing or envelope from deposition of metal from the arc. The housing can be made of ceramic, glass or the like, and insulates the contacts electrically from one another when the interrupter is open. By protecting the housing from metal deposition, the shield prevents or reduces deposition of metal that could produce an electrical path across the insulating housing.

During circuit interruption, separating the contacts introduces a voltage drop of a few tens to a few hundred volts across the drawn vacuum arc. In a successful interruption, as the arc current drops to zero, metal vapor evaporation from the contact surfaces decreases and finally stops. The envelope then returns rapidly to a very low pressure as the remaining metal vapor is deposited with no more metal being evaporated. The dielectric strength of the interrupter increases as the number of free metal ions in the area between the contacts decreases. Finally the circuit is interrupted. The circuit remains interrupted so long as the contacts or electrodes remain separated or insulated from one another, internally by a physical gap through a substantial vacuum, and externally by the insulating material of the envelope that carries the electrodes.

There are a variety of objectives in the design of vacuum interrupters. For example, when closed they must carry a nominal steady state current without undue resistive heating. When opening the contacts must produce sufficient metal vapor to permit the drawn arc to carry the circuit current while the current is reduced smoothly to zero. The objective is to manage rather than to eliminate arcing, because too rapid a reduction in current could cause an inductive voltage surge leading to damage in the associated distribution system and/or load apparatus coupled to the circuit.

Assuming that the arc is extinguished at a zero crossing of the AC voltage, there must be insufficient metal vapor in the evacuated volume to permit the arc to reignite in the next AC half cycle, when the AC voltage returns across the contacts. In addition to these requirements, the interrupter contacts preferably are configured to interrupt a wide range of currents, and should survive a large number of operations without failing, particularly for interrupters that are used as the usual switching means for coupling and decoupling power to loads.

The metal vapor ions that carry the electric arc are affected by electromagnetic forces. The current flowing through the open contacts produces an electromagnetic field that may cause an arc to move around on the surfaces of the contacts. Electromagnetic field strength is a function of current amplitude, but the distribution of current density in the gap depends on the nature of the arc, which can be columnar or diffuse. A diffuse arc usually occurs between the separating contacts of a vacuum interrupter at a current under 5 kA. This type of arc is characterized by a plurality of minute cathode spots that each carry a current between about 20 and 100 A, depending on the contact material. The spots emit the metal ions needed to carry current between the separating contacts. The usual shape for the contacts of a vacuum interrupter for circuits carrying currents under 5 kA is a disc shape, usually called a "butt" contact, with the contacts abutting along the substantially flat faces of the respective discs.

For currents greater than about 8 kA, a vacuum interrupter arc assumes a columnar shape, and resembles an arc in air. To successfully interrupt a circuit at this higher current level, the columnar arc needs to be controlled. There are two alternatives for controlling the arc. One method is to shape the electrodes as spirals or slotted cups, which are oriented so that the columnar arc is forced to move over the surfaces of the contact faces. Another method is to force the columnar arc to become diffuse even at this high current level, which can be accomplished by producing an axial magnetic field.

For still higher currents, over about 16 kA, a constricted columnar arc occurs. Arcs thus fall into several different modes, not limited strictly to diffuse arcs and constricted column arcs, and at transition currents between the foregoing current ranges the nature of the arc is uncertain. In addition, the current level varies over an AC halfcycle, and the current level can vary due to the timing of contact separation relative to the halfcycle. Arcs generally range from passive low-current diffuse arcs to intense high-pressure arcs with rapidly evaporating cathode and anode roots, subject to the particulars of arc initiation and current.

A circuit interrupter, for example for use in a contactor, is expected to function over a large number of interruption cycles at its nominal load circuit current, and a smaller number of interruptions at higher current, due to the more extensive electrode damage that occurs. Advantageously, an interrupter should be capable of at least $10^6$ operations at normal load current $I_L$; $10^5$ operations at $6\times I_L$, such as when switching a motor on and off for repetitive jogging applications; 50 operations at $10\times I_L$ (which is a standards requirement); and/or at least 3 operations at an extreme short-circuit current of $50\times I_L$.

If the interrupter is used for low-voltage applications, it is advantageous to employ a low current-chop contact material. "Current chop" is a measure of the extent to which the contact material causes the current during an interruption to extinguish suddenly while a voltage is still present rather than to drop smoothly to zero at the next zero crossing of the voltage. One low current-chop contact material is a powder metallurgy mixture of silver and tungsten-carbide (Ag—WC), which performs well in connection with low-current diffuse vacuum arcs. When the current is in the transition region, butt-type contacts made from this material do not always interrupt the current at the first AC current zero crossing following separation of the contacts. At progressively higher current levels, Ag—WC contact material becomes less and less effective, and at a sufficiently high current level such contacts will not interrupt the circuit successfully at all. It would be advantageous if the dependability of high-current circuit interruption using this material could be improved, to obtain the benefits of low current chop, especially by keeping the arc diffuse rather than columnar, at as high a current as possible.

Certain alternative materials are possible for the electrodes, such as Cu—Cr and Cu—Cr—Bi alloys. The need to maintain a diffuse arc in order to limit electrode damage is less critical with some such materials than with Ag—WC, but the circuit interruption performance of such materials is also enhanced if the arc can be kept in a diffuse state.

It is known to apply an axial magnetic field to improve the extent to which an arc remains diffuse, including with Ag—WC contact material. For example, U.S. Pat. No. 4,367,382—Suzuki et al. mentions currents as high as 40 kA. The Suzuki interrupters employ a floating metal-vapor shield. A magnetic field coil is located behind each of the contacts. The mechanism to operate the contacts separates the contacts at about 2 m/s. It would be advantageous if axial magnetic field means could be applied to a less complicated interrupter suitable for contactor-type mechanisms, in which the contacts typically open slowly (e.g., 0.5 m/s) and the interrupter generally needs to be compact, durable and inexpensive.

In commonly-owned U.S. patent application Ser. No. 08/488,401—Schulman and Slade, a novel interrupter style was disclosed in which a single internal axial-magnetic current coil was employed in conjunction with a vapor-condensing arc shield which is electrically isolated between two tubular electrical insulators. However, that style is still relatively complex since the shield is isolated, and this also results in an inherently high cost to manufacture. Therefore, that invention is most appropriate for the higher-end range of voltage applications in which the isolated arc shield is the best option for achieving the needed dielectric recovery and voltage withstand at high applied voltages. For these and other reasons, the present novel interrupter is needed.

SUMMARY OF THE INVENTION

It is an object of the invention to permit circuit interruption, particularly in contactor-type applications, at higher currents by maintaining a diffuse vacuum arc using a compact internal structure to produce an axial magnetic field in the contact gap.

These and other objects are accomplished by a vacuum circuit interrupter with a coil for generating an axially oriented magnetic field to maintain an electric arc in a diffuse rather than columnar mode upon opening of the interrupter. At least one of two electrodes having abuttable disc shaped contacts is movable via a metal bellows along an axis relative to the other and can be forced by an external mechanism to open. The electrodes are carried in a housing with an electrical insulator between opposite end mountings that support the electrodes with the contacts in an evacuated enclosure. One of the electrodes comprises an assembly including a rigid supporting member attached to one of the contacts and extending a length along the axis. A coil is wrapped circumferentially around the supporting member along this length, providing a conductive path to generate the axial magnetic field. The supporting member comprises a less-conductive (e.g., stainless steel) hollow sleeve or solid piece, and the coil is more conductive (e.g., copper), providing a durable and inexpensive structure.

The coil can make nearly a full helical turn, or can have at least two coil sections, each extending in a helical path around the support. Two such coil sections can be provided, each wrapped substantially 180° around the supporting member. The coil can be disposed on a fixed or movable electrode. For example on a fixed electrode, the coil can be coupled at one end to an associated one of the contacts and at an opposite end to the respective end mounting, and the support can be an integral stainless tubular sleeve that spaces the contact from the end mounting. In a fixed or movable electrode, the support can be a stainless sleeve that spaces a shank portion of an electrode from its contact, the coil being disposed in the gap. As a further alternative, a shank portion of an electrode can be bored to provide a sleeve that is integral with the shank portion for providing the gap for the coil.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

FIGS. 1 through 5 depict an inventive circuit interrupter 10 according to several alternative embodiments, the same reference numbers being used throughout the figures to identify the corresponding parts. Each of the drawings is a longitudinal section view, and each of the examples shown is a substantially axially symmetrical structure.

Figure 1:
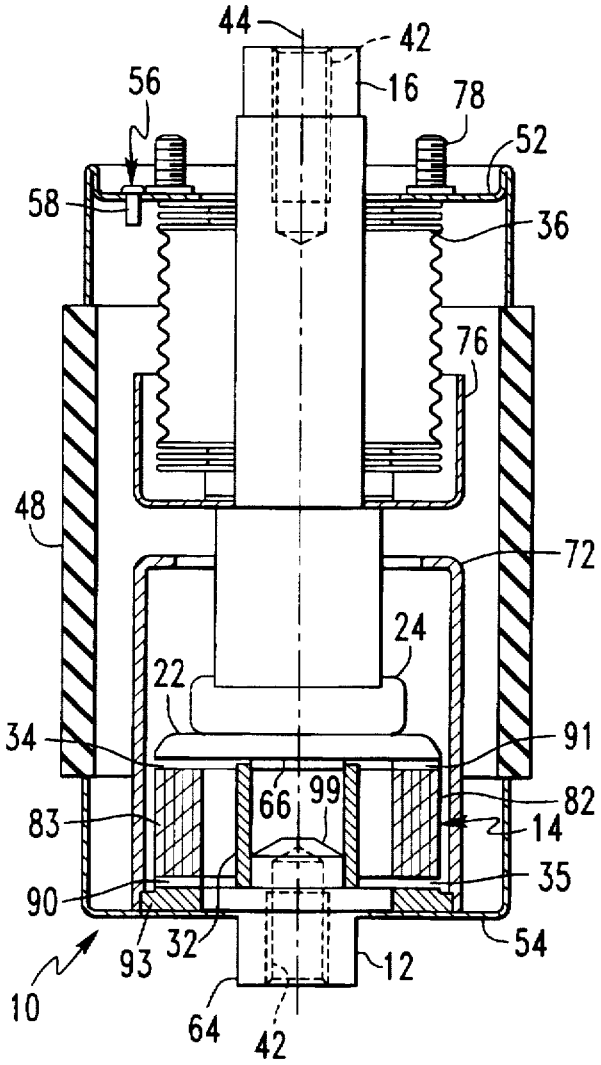
FIG. 1 is a longitudinal section view of a circuit interrupter according to the present invention.
Figure 2:
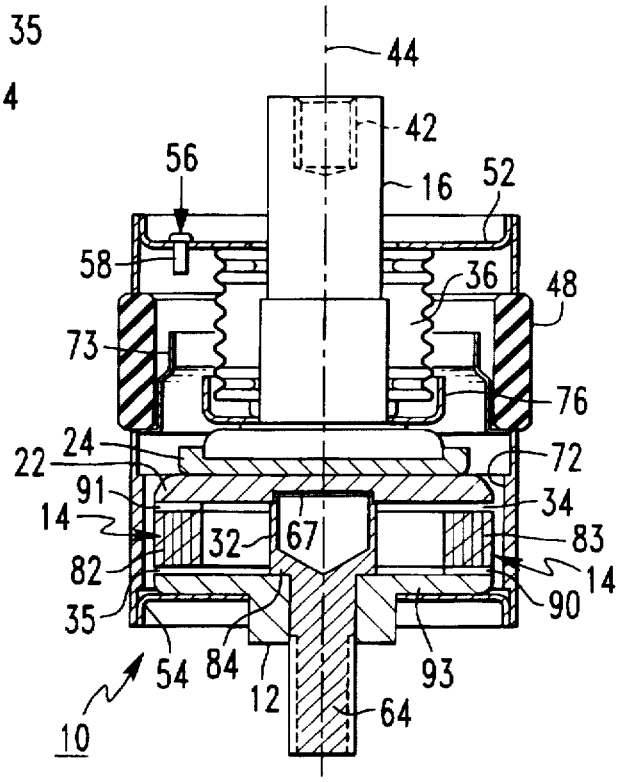
FIG. 2 is a section view illustrating an alternative embodiment.
Figure 5:
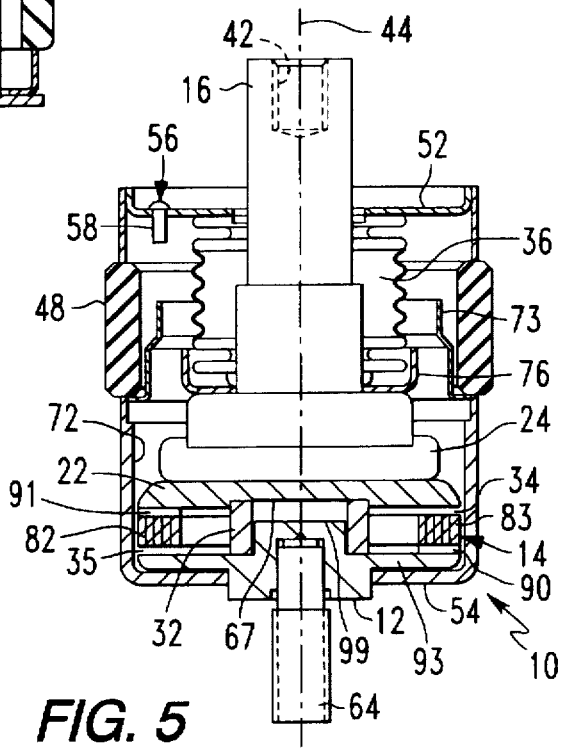
FIG. 5 is a full section view illustrating another alternative embodiment.

Firstly, the alternative embodiments of the inventive circuit interrupter disclosed here incorporate features which are in common with some interrupters of the present art. Some of these present-art features are described in the following four paragraphs: 1) In each of the drawings, circuit interrupter 10 has a first electrode 12 which is fixed against an end mounting 54 of the housing of the interrupter, and a second electrode 16 which is movable along a longitudinal axis 44 relative to the other electrode 12. The relative motion of electrode 16 is accomplished via a metal bellows 36, which is attached at one of its ends to the electrode 16 and at the other of its ends to the end mounting 52 which forms part of the housing of the interrupter. Electrode 12 is electrically connected to a disc-shaped butt contact 22, and electrode 16 is electrically connected to a disc-shaped butt contact 24. Contacts 22 and 24 are normally forced together to allow circuit current to flow through the interrupter 10. An external switching mechanism (not shown) can be attached to interrupter 10, for example by internal threads 42 in a shank portion of one or both of electrodes 12 and 16. Also, on the outer side of one or both of the end mountings, a means such as the threaded stubs 78 in FIG. 1 can be provided for physically mounting the interrupter to the external mechanism. In an alternative mode of operation, the housing of the interrupter 10 can be moved together with the "fixed" electrode 12, the other electrode 16 being the one that is actually held stationary relative to a larger mechanism. 2) Any of various forms of switching mechanisms having an actuator can be coupled to the interrupter 10 so as to separate the contacts 22 and 24 when interrupting the circuit current. The switching mechanism, for example, could be part of a protective device intended to interrupt a circuit current upon detecting a fault current, or part of a power distribution switching system (e.g., a distribution recloser or other switchgear), or a tap changer. It could also be a contactor in an application such as motor control (e.g. control of start/stop, forward/reverse, speed, etc.). For example, the embodiments of the invention as shown in FIGS. 2 and 5 are apt for a circuit interrupter such as an industry size 6, but the inventive aspects are applicable to other sizes and capacities as well. 3) Alternatively, electrode 12 can also be made movable relative to the housing of the interrupter 10 by a corresponding attachment of a metal bellows to electrode 12. The essential requirement for mechanical operation is a means by which contacts 22 and 24 can be forced together for carrying the current between electrodes 12 and 16, and then separated for interrupting the current through the drawn vacuum arc, with the housing maintaining the internal high vacuum required for fast dielectric recovery and the capacity to withstand the applied voltage. 4) The housing of the interrupter 10 comprises a substantially tubular electrical insulator 48 attached hermetically between opposite end mountings 52 and 54, which both have an opening through which the associated electrode 16 or 12 protrudes. The end mountings 52 and 54 are usually electrically coupled with the respective electrodes 16 and 12. In all the drawings, end mounting 54 supports and hermetically seals with the fixed electrode 12, and the metal bellows 36 hermetically seals at one of its ends to electrode 16 and at the other of its ends to end mounting 52. The electrodes 12 and 16, the metal bellows 36, the end mountings 54 and 52, and insulator 48 together define a gas-tight enclosure surrounding contacts 22 and 24. For example, either or both of the end mountings 52 and 54 can be a single metal cup which is joined at its top to insulator 48, as end mounting 54 is depicted in FIGS. 1 and 5. Likewise, either or both of the end mountings 52 and 54 can have a two-part construction with a tubular collar to which an end cap is attached and hermetically sealed (e.g., by brazing or tungsten inert gas welding along the junction), as end mounting 52 is depicted in various ways in all the drawings. The insulator 48 can comprise a high-alumina ceramic ($A1_2O_3$), or alternatively, a glass or porcelain material. In general, it is also possible to construct the housing with multiple insulator sections separated by tubular metal sections. According to one possible manufacturing method, the gas-tight enclosure is evacuated through a portal 56 which is sealed by a pin 58, as depicted in FIG. 1.

Secondly, the main inventive aspects of the interrupter 10 relate to the means provided for establishing an axially-directed magnetic field in the contact gap using the flow of circuit current, and the optimal choice of contact materials which this allows. In each of the embodiments, a single current-carrying coil 14 of special design is provided, which is designed to generate a substantially axially-oriented magnetic field when current passes through interrupter 10. In conjunction with this, a metal shield for condensation of metal vapor is provided, which is electrically connected to one of the two electrodes. The coil 14 can be associated either with the fixed electrode 12 (FIGS. 1, 2, and 5) or with the movable electrode 16 (FIGS. 3 and 4) in the following way, with the numbering of parts being general to all the drawings.

The coil 14 has an electrical connection 90 at one of its ends to its associated electrode 12 or 16, and an electrical connection 91 at its opposite end to its associated contact 22 or 24. This contact is spaced from the internal end of the associated electrode by a support member 32 which provides the space to accommodate the height of coil 14, plus additional space 35 between the coil and the electrode and space 34 between the coil and the contact. It is within these spaces 35 and 34 that the electrical connections 90 and 91, respectively, are made. Supporting member 32 extends for a length axially. The coil 14, which defines a conductive path wrapping circumferentially around support member 32, extends along this length and provides a conductive path for the circuit current. Due to the circumferential wrapping, coil 14 produces an axially-oriented magnetic field when current flows through it. The structure is arranged and the materials are chosen such that most of the current passing through interrupter 10 passes through coil 14 and not through supporting member 32. Supporting member 32 and coil 14 can both be electrically conductive. However, coil 14 is more conductive than supporting member 32, due to the choice of structure and/or material of the coil and supporting member, respectively. Coil 14 preferably comprises a highly conductive and relatively thick ribbon of solid copper. Support member 32 preferably comprises a less-conductive material such as stainless steel. Support member 32 is shown formed as a relatively thin tubular sleeve, but it can alternatively be a solid piece. Alternatively, support member 32 can be made from a mechanically strong insulating material. The longitudinal center axes of the electrodes, coil and support member are preferably designed to be coincident with the longitudinal center axis 44 of the interrupter 10.

In all the drawings, coil 14 is shown in a preferred embodiment in which it comprises two semi-circular half-coil sections 82 and 83. Each coil section 82 and 83 extends in a helical path around support member 32. The coil sections 82 and 83 are each electrically connected on one of their ends to the periphery of an increased-diameter extension 93 of the associated electrode, and electrically connected on the other of their ends to the back of the associated contact at its periphery. All the drawings show the electrical connection 90 of coil section 83 to the extension 93 of the associated electrode, and the electrical connection 91 of coil section 82 to its associated contact. Half-coil sections 82 and 83 each wrap substantially 180° around support member 32, with part of these angular distances also being occupied by the electrical connections 90 and 91. It is also possible to employ a single-section coil which encompasses substantially 360°, or additional smaller coil sections. For example, for a coil comprising three sections, each section encompasses substantially 120°. It is also possible to provide overlapping coil sections, for example in a double helix wherein each section encompasses substantially 360° and the sections run in parallel.

A boss 99 (FIGS. 1, 3 and 5) or depression 100 (FIG. 4) can be provided that properly positions supporting member 32 at its end which faces its associated electrode stem. The butt contact associated with the coil 14 can likewise include or support a boss 66 (FIGS. 1, 3 and 4) or depression 67 (FIGS. 2 and 5) that properly positions supporting member 32 at its end which faces that contact.

Figure 3:
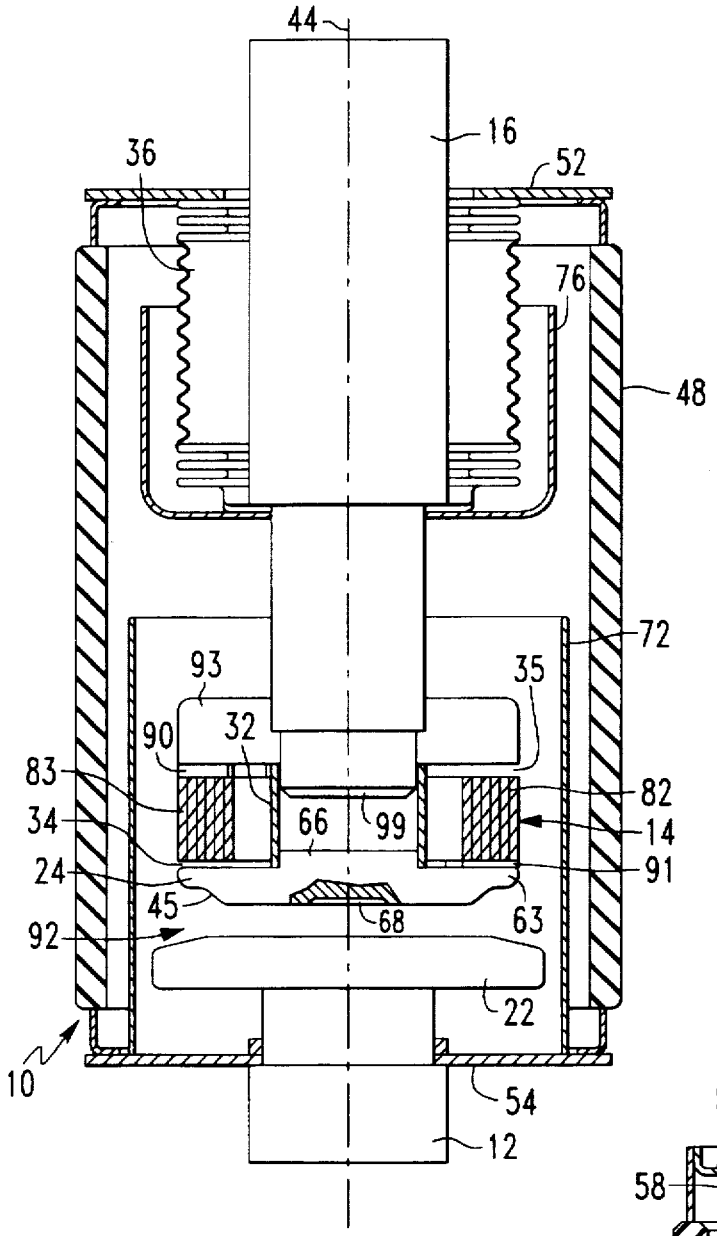
FIG. 3 is a section view illustrating an alternative embodiment.
Figure 4:
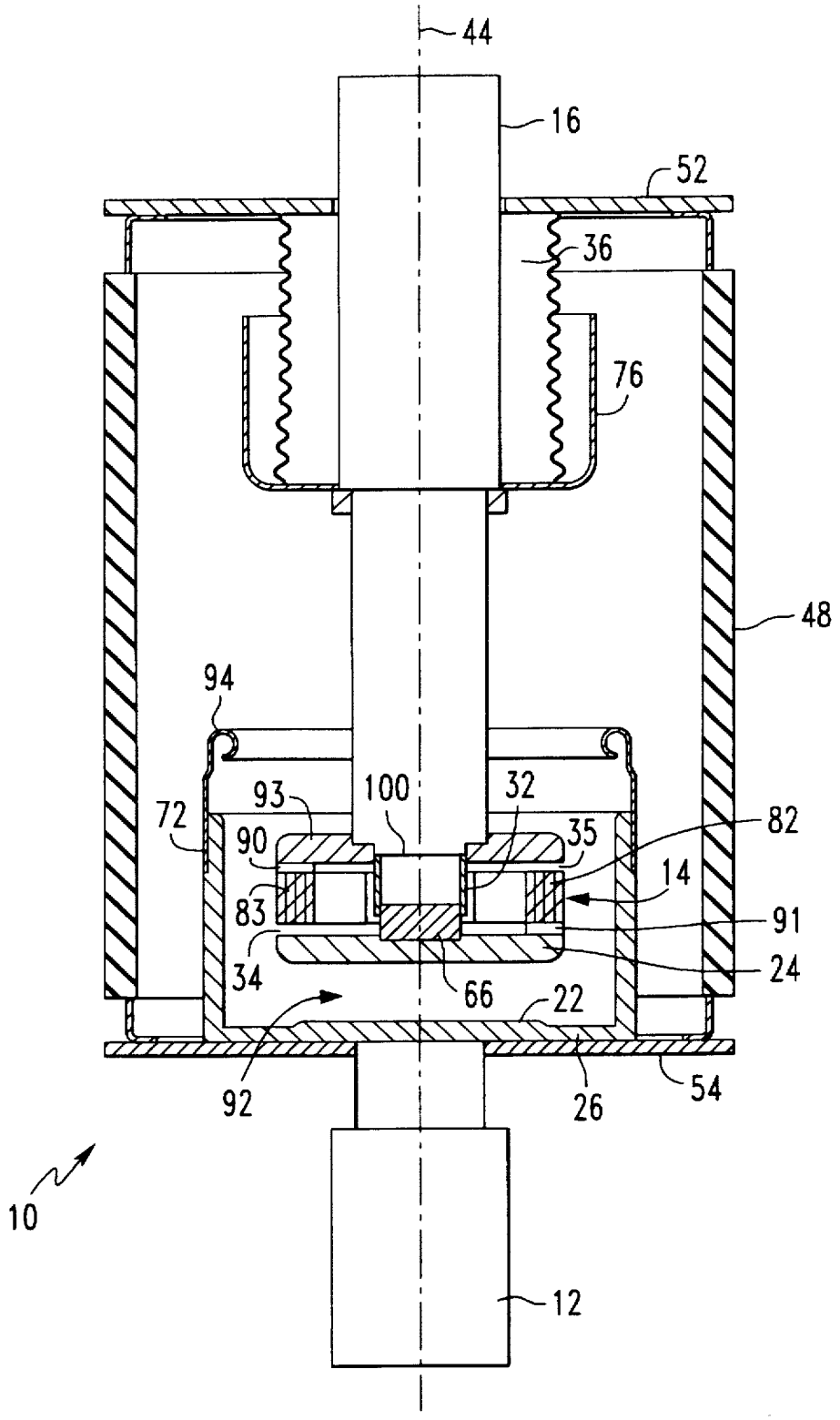
FIG. 4 is a full section view illustrating an alternative embodiment.

The metal shield 72, which provides for the condensation of metal vapor from the arc, extends axially at least far enough to surround contacts 22 and 24 in their open position. This ensures that the shield 72 will fully surround the axial length of the maximum contact gap 92 in which the vacuum arc occurs, as shown in FIGS. 3 and 4. Shield 72 can be straight, as shown in FIG. 3, or it can be bent, for example, inwardly at its open end as shown in FIG. 1. The shield also can support attached section 94, for example as shown in FIG. 4. Another possible configuration of the shield 72 is shown in FIGS. 2 and 5, in which shield 72 comprises a section 73 which is attached on the end of insulator 48 and extends along the direction of axis 44 and somewhat inwardly to protect the insulator 48 from metal vapor generated by the arc. In conjunction with this, the axially-extended section of metal end mounting 54 of the housing simultaneously serves as the vapor-condensing surface in the region of the contact gap, corresponding to the definition of shield 72. The preferred inward bending of the shield 72 at its open end serves to enhance the plating of metal vapor from the drawn electric arc onto shield 72 rather than on the inner surface of insulator 48. Shield 72 is preferably electrically and mechanically connected to fixed electrode 12 through end mounting 54. It is also preferably spaced radially from movable electrode 16 and its associated contact 24 by a distance substantially equal to or greater than the maximum separation gap of contacts 22 and 24, thereby promoting the confinement of the electric arc to the contact gap 92. Alternatively, the shield 72 could be electrically and mechanically associated with the movable electrode 16.

For a medium current and voltage level, butt contacts 22 and 24 preferably comprise a low current-chop material such as Ag—WC or Cu—Cr—Bi. The use of Ag—WC is normally limited to low currents, and cannot be extended to the medium current range claimed in this invention. However, use of Ag—WC material is made possible in these embodiments at medium currents by the inventive use of the single coil 14, which provides the axially-oriented magnetic field which forces the vacuum arc to assume a low-erosion diffuse mode, even at medium currents. For higher power circuits, a Cu—Cr or Cu—Cr—Bi material is preferred, but for Cu—Cr the current chop level is higher.

The embodiments depicted in the drawings include several possible features to enhance mechanical, electrical, and/or manufacturing aspects of the interrupter 10. FIGS. 2 and 5 show how the fixed electrode 12, when associated with the coil 14, can include or provide support for a cylindrical stub 64 which is made from a strong material of lower conductivity than the electrode 12. Stub 64 is shown threaded on its outside for receiving a nut (not shown) by which it can be attached to the switching mechanism (not shown). In particular, the arrangement shown in FIG. 5 employs a minimum of parts and provides a durable and inexpensive interrupter that is readily manufactured. It uses a mounting stub 64, and an end mounting 54 of the one-piece cup type described above which also serves as the main part of the arc shield 72. The electrode 12, the boss 99, the electrode extension 93, the sections 82 and 83 of the coil 14, and the electrical connections 90 and 91 are all of one piece of high-conductivity material such as copper.

In the embodiments of FIGS. 1, 3, 4 and 5, support member 32 comprises a separate length of low-conductivity tubing (e.g., stainless steel) fit between its associated electrode and contact for maintaining a space to accommodate coil 14 while structurally bearing the closing force exerted on the contacts. An alternative embodiment that has minimal parts and is particularly compact, durable and inexpensive, is shown in FIG. 2. According to this embodiment, stub 64 and supporting member 32 are integral. The supporting member 32 is provided by boring out the inner end of an extended shank portion 84 of stub 64, which is made from a low-conductivity material (e.g. stainless steel). By boring the end of this piece to provide a thin tubular sleeve at the end which is attached to contact 22 so as to maintain the required spacings 34 and 35, the resistance of the section which now comprises supporting member 32 is high compared to that of coil 14, as desired.

FIG. 3 illustrates a preferred embodiment of the contact which is associated with the coil 14 (i.e., contact 24 in this case). A step 45, preferably smooth, is machined into the periphery of the face of the contact 24, in such a way that the outer one-half, approximately, of the radial thickness of the coil sections 82 and 83 are in line axially with the outermost, smaller-thickness section 63 of the step on the periphery of the contact. We have found that this promotes the containment of the diffuse arc within the central region of the gap bounded radially by the step 45, so the arc does not substantially enter into the region of the smaller-thickness section 63 in which the magnetic field has a diminished axial component due to its position relative to the coil sections. FIG. 3 also shows the option of a central depression 68 in one of the contacts (contact 24 in this case), which we have found to reduce contact welding and to promote weld breaking. FIG. 4 illustrates an alternative embodiment in which coil 14 is disposed on movable electrode 16 in a fashion similar to FIG. 3, but contact 22 associated with fixed electrode 12 is formed integrally as a portion of a cup made from contact material, which is affixed at its base 26 to end mounting 54, and which extends axially to provide shield 72. It is also shown in FIG. 4 that boss 66 which connects support member 32 to contact 24 can be made as a separate piece from a low-conductivity material (e.g., stainless steel).

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A circuit interrupter, comprising:

first and second electrodes having abuttable contacts, at least one of the electrodes being movable along a longitudinal axis relative to the other of the electrodes, the contacts being abutted together for carrying current between the electrodes and separated for interrupting the current and striking an arc between the contacts, at least one of said electrodes being urged toward the other by external pressure and configured for attachment to a mechanism operable to force the contacts apart;

a housing including an electrical insulator disposed between opposite end mountings, the end mountings supporting the electrodes, said electrodes, end mountings and insulator together defining an evacuated enclosure surrounding the contacts;

at least one of the electrodes comprising a rigid supporting member attached to one of the contacts, the supporting member extending a length along the longitudinal axis, and at least one coil defining a conductive path wrapping circumferentially around the supporting member and extending along said length, the coil providing a conductive path for the current such that the coil produces an axially oriented magnetic field;

wherein the supporting member and the coil are both electrically conductive and the coil is more conductive than the supporting member; and wherein said one of the electrodes comprises a shank portion, the supporting member comprising a stainless steel tubular sleeve being disposed between the shank portion and said one of the contacts for maintaining a gap between the shank portion and said one of the contacts, the coil residing in the gap.

2. The circuit interrupter of claim 1, wherein the tubular sleeve is an integral sleeve disposed along said one of the electrodes.

3. The circuit interrupter of claim 1, wherein said one of the electrodes is fixed relative to the housing.

4. The circuit interrupter of claim 3, wherein at least one of the contacts has one of a cup-shaped central depression and a peripheral step facing the other of the contacts.

5. The circuit interrupter of claim 3, wherein at least one of the contacts has both a cup-shaped depression and a peripheral step, facing the other of the contacts.

6. The circuit interrupter of claim 1, wherein said one of the electrodes is movable relative to the housing.

7. The circuit interrupter of claim 1, wherein at least one of the contacts comprises a substantially disc-shaped profile for butt contact with the other of the contacts.

8. The circuit interrupter of claim 7, wherein at least one of the contacts is surfaced with a material comprising at least one of Ag—WC and Cu—Cr—Bi.

9. The circuit interrupter of claim 7, wherein at least one of the contacts is surfaced with a material comprising an alloy of Cu and Cr.

* * * * *